United States Patent [19]

Gorski

[11] Patent Number: 4,483,451

[45] Date of Patent: Nov. 20, 1984

[54] BOTTLE CLOSURE DEVICE

[76] Inventor: Florian J. Gorski, 8324 Berkhamstead, Orland Park, Ill. 60462

[21] Appl. No.: 450,798

[22] Filed: Dec. 17, 1982

[51] Int. Cl.[3] ..... B65D 39/16

[52] U.S. Cl. ..... 215/296; 215/299

[58] Field of Search ..... 215/296, 299, 360, 358

[56] References Cited

U.S. PATENT DOCUMENTS

| | | | |
|---|---|---|---|
| 820,469 | 5/1906 | Bennett | 215/360 X |
| 884,322 | 4/1908 | Deusch | 215/296 X |
| 1,036,893 | 8/1912 | Parker | 215/299 |
| 1,146,036 | 7/1915 | Spinks | 215/360 |
| 1,448,051 | 3/1923 | Borne et al. | 215/360 |

FOREIGN PATENT DOCUMENTS

| | | | |
|---|---|---|---|
| 109863 | 4/1925 | Switzerland | 215/299 |

*Primary Examiner*—Donald F. Norton

*Attorney, Agent, or Firm*—Conlon & Kerstein

[57] ABSTRACT

A bottle closure device adapted to be attached to a cork used to seal bottles and including a cork piercing shaft with a bottom adapted to be inserted through the cork and until the bottom disk portion comes in contact with the bottom of the cork. A top cap is then threaded onto the portion of the shaft extending through the cork and tightened and brought into contact with the cork to firmly restrain the cork at both ends to allow it to be reinserted into a bottle. Thus, after a cork is removed by a conventional corkscrew, this attachment allows the cork to be reused without disintegrating or breaking into pieces and entering the bottle or coming into contact with the fluid in the bottle.

7 Claims, 5 Drawing Figures

3
4
5
10
12
14
16
18
20
22
24
26
28
30
32
34
36
38

BOTTLE CLOSURE DEVICE

BACKGROUND OF THE INVENTION

1. Field of the Invention

This disclosure pertains to closure devices and in particular to a device intended to be attached to corks to allow the corks to be reused in such a fashion that the associated bottle can be tightly sealed and the cork preserved without breaking up.

2. Description of the Prior Art

Prior art closure devices have avoided the problem of reusing corks because the corks are somewhat fragile and break into pieces with portions of the cork entering the bottle and resulting in an unsightly accumulation atop the beverage. Particles of cork entering an expensive wine are unsightly and certainly affect the desirability of a wine although normally the taste is not affected. Thus, over the years, it has been the practice to find other means to seal wine bottles in order to avoid the problem of corks breaking into pieces and entering the bottle. Thus, various rubber and plastic closure members have been provided in the industry. However, because of the unique nature of a cork which allows the wine to breath and relieve gases from the bottle, and because of its chemical neutrality with respect to wines, a cork is the natural closure member and the most desirable closure member for resealing wine bottles.

The closure member disclosed in this patent allows corks to be reused by the attachment of the two members provided herein which nestle the cork securely and prevent it from breaking into pieces. Thus, the original cork may be reused many times without the problem of cork breakup or ineffective sealing which has existed heretofore.

SUMMARY

This disclosure pertains to an attachment device which can be easily inserted through a cork and attached thereto to permit the cork to be reused many times without breaking into pieces or loosing its sealing capabilities. By inserting one portion through the center of a cork which has already been pierced by the corkscrew and thus rendered easily inserted, and attaching a corresponding cap member, the top and bottom of the cork are restrained in further breakup after removable by a corkscrew is reduced and even eliminated. After attachment of the cork preserving device, it is tightened slightly about the cork to allow the cork to be easily reinserted into the neck of its bottle. After insertion the device can be tightened slightly to bring the upper and lower portions of the cork-engaging device into closer engagement with the cork causing it to expand slightly and produce a complete seal. When removal is desired, the top portion is unscrewed slightly and the unit and cork are easily removed from the bottle. Thus, the attachment to the cork and subsequent removal of the cork from its bottle are done in such a fashion that the cork is preserved as a unit and the usual breakup of the cork into smaller pieces is eliminated. Also, not only is the cork preserved but the wine does not lose any of its desirable visual features caused by floating cork particles. Not only is the wine devotee allowed to enjoy the taste of the wine in its naturally preserved condition sealed by the original cork but the consistency of the wine fluid may also be completely observed without the visual distraction of floating cork particles.

It is thus an object of this disclosure to provide a device for preserving corks to allow a cork to be reused without breaking up.

More specifically, another object of this invention is to provide a device that can be easily attached to a cork by providing one member that is inserted through the center of the cork and having a corresponding bottom to come in contact with one end of the cork and which cooperates with a second or top portion comes in contact with the other end of the cork to thus nest the cork within these two members to allow a cork to be reinserted and easily removed from its bottle.

Yet, another object of this invention is to provide a cork preserving member having a top portion adapted to mate with a treaded portion of the cork inserted member to allow the top portion to be slightly tightened about the cork to allow the cork to be held in a captive position as it is removed and also allow the cork to be slightly tightened and expanded to complete this seal between the cork and the bottle once the cork is reinserted into a bottle.

These and other objects of the invention will become apparent to those having ordinary skill in the art with reference to the following description, drawings, and appended claims.

DESCRIPTION OF THE PREFERRED EMBODIMENT

Figures 1, 2, 3, 4, 5:
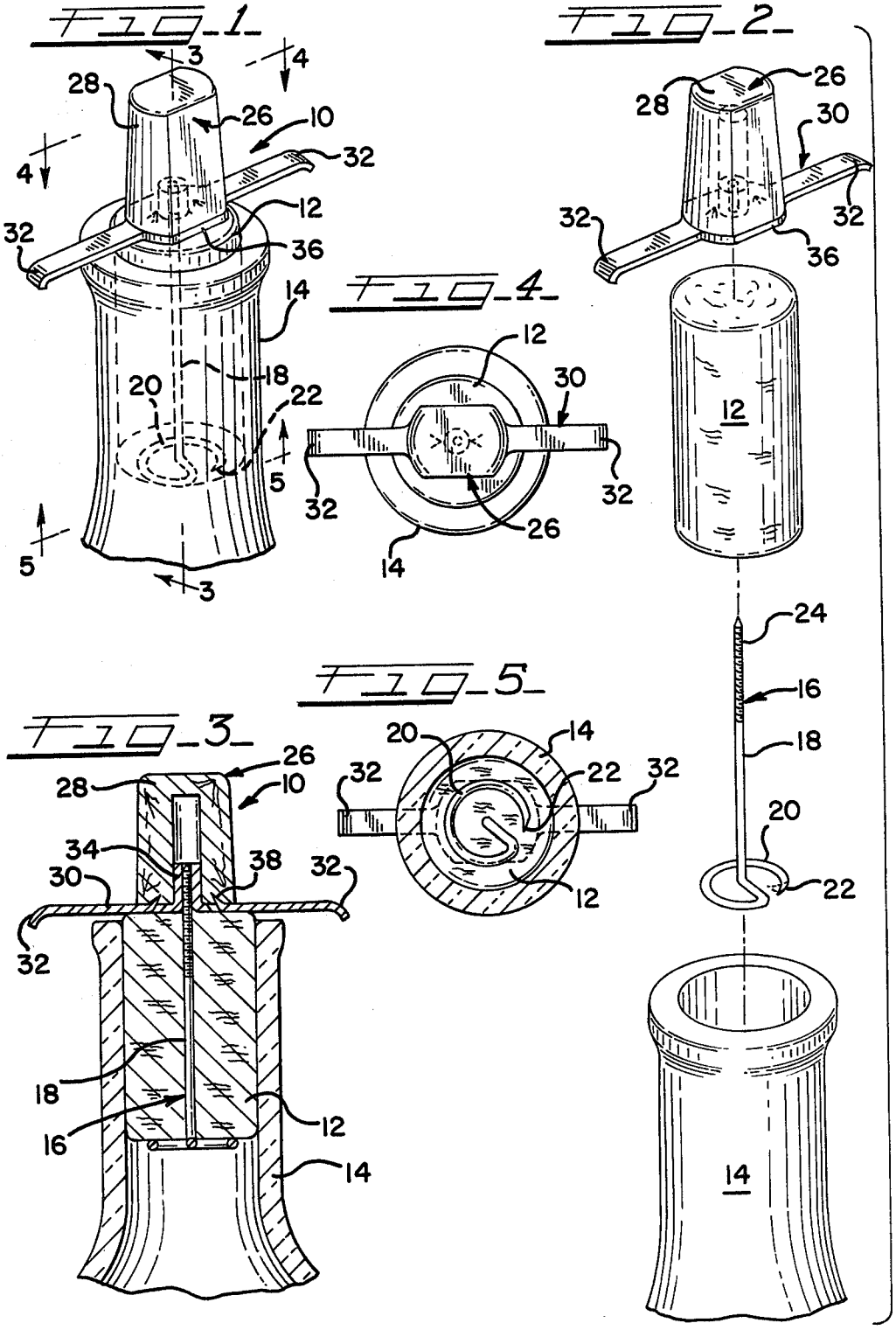
FIG. 1 is a pictorial illustration of the closure member attached to a cork and inserted in an appropriate bottle.
FIG. 2 is an exploded illustration of the closure device.
FIG. 3 is a sectional view taken generally along lines 3—3 of FIG. 1.
FIG. 4 is a view taken generally along lines 4—4 of FIG. 1.
FIG. 5 is a view taken generally along lines 5—5 of FIG. 1.

Referring now to the drawings and in particular to FIG. 1, the closure device shown as it would appear when attached and inserted and in position. The closure device is designated generally by the numeral 10 and is shown attached to cork 12 and inserted in a neck of a bottle 14. The closure device 10 includes an insertable member 16 (FIG. 2) which has a sharpened end and a shaft portion 18. At the bottom of the fat portion there is a bottom disc type member adapted to be engaged by a person's thumb and pushed through the center of the cork until the bottom 20 comes in contact with the bottom of the cork. It is anticipated that the insertable piercing member 16 would easily fit through the center of a cork which has been previously removed because of the initial opening in the cork resulting from a corkscrew used for removal of the cork 12. At the end opposite the bottom 20 is a pointed section 22 which further facilitates insertion of the cork 12. As shown in FIG. 3, when in position the insertable member or the shaft 18 has a threaded shaft extension 24 which extends from the cork 12.

A cap member 26 operates in conjunction with the piercing member 16 inserted into the cork 12. The cap member 26 includes a top 28 which may be a separate member made of plastic or wood and covers the point of shaft 18. A metal twist member 30 is positioned adjacent the top 28 and includes tightening fingers 32 which extend outwardly from the top 28. Each finger 32 may have downwardly turned ends or rounded ends to allow the fingers to be easily grasped for providing addition tightening.

The center part of the twist member 30 includes an extruded, internal thread 34 which fits about the threaded portion of the shaft extension 24. Also, the twist member 30 has a larger central section 36 which is adapted to come in contact with the associated end of the cork 12. Thus, when the closure device is positioned about a cork 12, the bottom 20 and the square flat washer 36 of the cap 26 are in contact with both ends of the cork. It is anticipated that after initial contact is obtained that the cap means 26 be engaged and twisted slightly in order to completely grip and restrain the cork prior to its insertion into a bottle 14. Once in such position, the cork and closure member can be completely reinserted or partially inserted if desired by the user, into the bottle 14. After insertion, the fingers 32 may be grasped to provide more turning force for tightening the cap on the threaded shaft 18. As the fingers are grasped and the cap tighten the cork will tend to be shortened in length thus causing it to expand slightly and provide a complete seal.

It is anticipated that the insertable member 16 which also has the wire form 20 would include an upwardly turned end or point 22, (FIG. 2). Thus if the bottom would tend to turn as the cap 26 is being tightened, the point 22 would become further imbedded in the cork 12 and thus prevent additional turning. The insertable member 16 is anticipated as being manufactured from stainless steel or another material which would not oxidize or otherwise contaminate wine should it come in contact with the wine. For example, when the bottle is stored in a horizontal position.

Cap means 26 is attached about the extruded portion 34 with a suitably commercially available adhesive. Further, barbs 38 are provided in the twist member 30 to further provide a mechanical connection between the cap means 26 and the twist member 30.

The closure device 10 may be reused after the wine is finished by simply unscrewing the two members and removing the insertable member 16 from its cork.

Thus it is noticed from the foregoing that the product disclosed allows the corks to be reused after they are initially removed from a wine bottle or any bottle. It is anticipated that most corks are removed by corkscrews and because of the nature of a corkscrew, the corks are damaged during this initial removal. Consequently, the damage results in bits of the cork frequently falling into the wine if the cork is attempted to be reused. The product shown herein securely grips the top and bottom of each cork and thus prevents bits of cork from falling into the wine which result in diminished visual attractiveness of the wine and also require the consumer to remove the cork bits before consuming the wine.

The foregoing description and drawings merely explain and illustrate the invention and the invention is not limited thereto, except insofar as the appended claims are so limited, as those who are skilled in the art and have the disclosures before them will be able to make modifications and variations therein without departing from the scope of the invention.

What is claimed is:

1. A closure device adapted to be attached to a cork used to seal a bottle, the improvement comprising:

cork attachment means formed of a single piece of wire and formed to provide a shaft adapted to be inserted into and through the cork; and including a threaded extension to protrude upwardly from the cork;

said cork attachment means also including a pointed top and also including a bottom connected with the shaft to assist in urging the pointed top of said shaft into the cork before said bottom comes into contact with the cork;

cap means including a top with a hollow chamber to receive the pointed top of the shaft and also including a twist-grip finger means with threaded means and located between the top and the cork and adapted to be connected to the threaded extension of the shaft, and, said twist grip finger means having portions extending outwardly of the cork to be grasped when threading the twist grip finger means onto the shaft whereby the closure device may be attached to a cork to allow the cork to be easily re-inserted and removed from the associated bottle without breaking into pieces.

2. The closure device of claim 1 wherein said bottom further includes:

a rounded wire form portion extending from and forming an integral part of the shaft, and, said rounded wire form having a first portion extending outwardly from the shaft and a second portion extending in a circular, clockwise direction when viewed form above.

3. The closure device of claim 1 wherein the bottom further includes:

a pointed end;

said pointed end having a bend portion adapting the pointed end to contact and pierce the bottom of an associated cork.

4. The closure device of claim 1 wherein the cap means further includes:

a generally cylindrical top having a height extending away from the captivated cork and also having a width, said height being of greater dimension than the width;

means joining the top to the twist-grip means to allow both to turn in unison.

5. The closure member of claim 4 wherein said twist-grip means includes deformed barbs extending upwardly therefrom into engagement with said top and thereby providing a mechanical connection between the top and twist-grip means.

6. The closure device of claim 1, and:

said twist-grip means having elongated threaded means to receive the threaded extension of the shaft and to thereby permit the twist grip means to be rotated and brought into snug engagement with a cork by capturing the cork between the twist grip means and the bottom of the cork attachment means.

7. The closure device of claim 6 wherein said twist-grip further includes:

a flat metal member with a threaded opening provided by an internally formed extruded portion having said threaded means.

* * * * *